United States Patent [19]

Vertegaal

[11] 4,256,037

[45] Mar. 17, 1981

[54] APPARATUS FOR INTERMITTENT PRINTING

[75] Inventor: Jacobus G. Vertegaal, Boxmeer, Netherlands

[73] Assignee: Stork-Brabant B.V., Boxmeer, Netherlands

[21] Appl. No.: 8,157

[22] Filed: Jan. 31, 1979

[30] Foreign Application Priority Data

Jan. 31, 1978 [NL] Netherlands ..... 7801102

[51] Int. Cl.[3] ..... B41F 15/10; B41F 13/40; B41F 5/06

[52] U.S. Cl. ..... 101/115; 101/118; 101/181; 101/182

[58] Field of Search ..... 101/115, 116, 117, 118, 101/119, 120, 180, 181, 182, 183, 184, 172, 247; 92/13.4, 13.6; 198/689, 811, 809, 826, 837

[56] References Cited

U.S. PATENT DOCUMENTS

| | | | |
|---|---|---|---|
| 2,263,323 | 11/1941 | Wickwire, Jr. | 101/182 |
| 3,549,004 | 12/1970 | Zysman | 198/811 |
| 3,605,567 | 9/1971 | Cooper | 92/13.4 |
| 3,921,519 | 11/1975 | Zimmer | 101/181 X |

*Primary Examiner*—J. Reed Fisher
*Attorney, Agent, or Firm*—Edmund M. Jaskiewicz

[57] ABSTRACT

An apparatus for the intermittent printing of material has at least one printing cylinder and an endless band for supporting the material to be printed. A portion of the band which is in printing engagement with the printing cylinder is supported on one side by supporting members and each supporting member is positioned opposite a printing cylinder. Each supporting member is movable transversely away from its respective printing cylinder. The pressure on the side of the band supported by the supporting member is less than the atmospheric pressure on the other side of the band so that when the supporting member is moved away from the printing cylinder the endless band will remain in contact with the supporting member and thus be spaced away from the printing cylinder.

3 Claims, 5 Drawing Figures

APPARATUS FOR INTERMITTENT PRINTING

The present invention relates to the intermittent printing of material supported upon an endless band moving below a printing cylinder, more particularly, to the structure to moving the supporting band and material away from the printing cylinder.

A known form of a printing apparatus includes at least one printing cylinder and an endless band for supporting the material which is to be printed. The portion of the band which is engageable by the printing cylinders is supported on its other side by one or more supporting members each of which is positioned substantially opposite to a respective printing cylinder. A specific form of printing apparatus is disclosed in the U.S. Pat. No. 3,990,363 wherein the printing cylinders consist of thin-walled cylindrical stencils in each of which is mounted an internal squeegee. During the printing of a cylinder, the squeegee within the cylinder is positioned so as to press the printing paste or ink through the perforations of the stencil. During inactive periods when the printing cylinder is not printing, its squeegee is lifted to a position out of contact with the interior of the cylinder so that the printing paste or ink is not forced through the stencil perforations but remains within the stencil.

During particular printing operations it is desirable that during the inactive or non-printing period contact between the printing cylinder and the material to be printed supported on the endless band be separated in a positive manner. This may be, for example, lifting of the printing cylinder from contact with the material to be printed. However, this arrangement is not particularly satisfactory since difficulties may be encountered in properly and accurately lifting the printing cylinder because of its mass and also in maintaining the printing cylinder in driving relationship while it is in its lifted position.

While it would appear that the endless band can be moved from the printing cylinder in several different ways, most of these structures for moving the band have disadvantages. Since one side of the band supports the material to be printed it is not feasible to press the band mechanically away from the printing cylinder. Consideration has also been given to the application of air under pressure to the top surface of the band. But the application of this air may bring about a drying effect with respect to the respective printing cylinder and this drying is especially undesireable particularly when cylinder stencils are used. Pressing or drawing the endless band away from the printing cylinder by means of magnetic forces is not particularly satisfactory since for that purpose metallic elements must be incorporated in the endless band.

It has been proposed in the Dutch patent application 72.15339, that was open to public inspection on May 17, 1973, to provide a screen printing machine wherein a suction box is located under the endless band at each location of a printing cylinder. However, it is noted that such an arrangement requires a considerably greater difference of pressure, that is the subatmospheric pressure within the suction box must be quite low, and this in turn causes a greater frictional resistance by the band moving along the edges of the suction box. Also, a moving along of the suction boxes is required.

It is therefore the principal object of the present invention to provide a novel and improved apparatus for intermittent printing by achieving a positive interruption of the contact between the endless band supporting the material to be printed and the printing cylinder.

The present invention essentially comprises a suction box whose edge cooperates with a surface of the band to constitute the means for displacing the band away from the printing cylinder. The band together with a supporting member in the form of a roller or the like can then be moved away from the printing cylinder, for example, along a distance of 5 mm, to produce a temporary interruption of the printing operation of a particular printing cylinder.

According to one aspect of the present invention an apparatus for intermittent printing of material comprises at least one printing cylinder and an endless band which supports a material to be printed. A portion of the endless band is movable below the printing cylinder and in contact therewith. At least one supporting member is positioned below the moving portion of the band and opposed from a respective printing cylinder. Means are attached to the supporting member to displace individually this supporting member in a transverse direction away from the printing cylinder. There are also means engageable with the band for maintaining a pressure on the supported side of the band which is less than the atmospheric pressure acting upon the side of the band upon which the material to be printed is supported. As a result of this difference in pressure, when the supporting member is moved away from the printing cylinder, the band will also move away from the printed cylinder and will continue to be supported on the supporting member.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
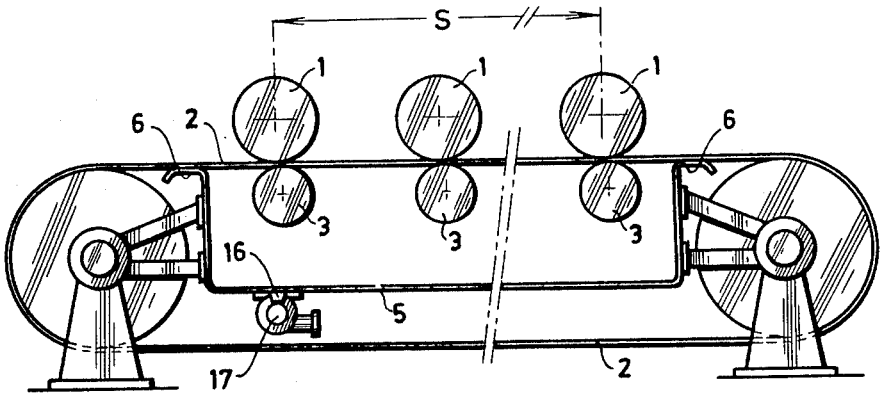
FIG. 1 is a vertical sectional view of a portion of a screen printing machine illustrating three stencils in their active or printing positions.
Figure 2:
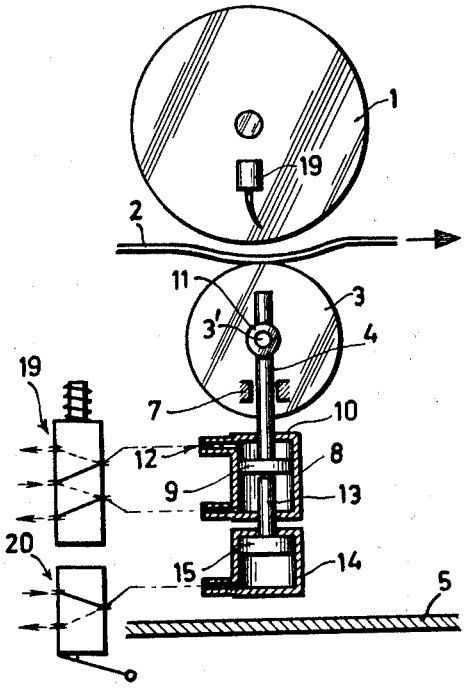
FIG. 2 is a view showing only a portion of FIG. 1 and illustrating the relative positions of the printing cylinder and its supporting roller when printing is interrupted.

The printing apparatus illustrated in FIGS. 1 and 2 is of the type as disclosed in the U.S. Pat. Nos. 3,892,176, 3,785,284, 3,933,093, 3,675,571, 3,718,086, 3,420,167 and 3,304,860. Such a printing apparatus comprises a number of printing stencils which in this embodiment consist of thin-walled cylindrical stencils 1 of which three are represented in the drawings, although it is to be understood in practice the apparatus may comprise 8–12 stencils. An endless band or web 2 is moved below the printing cylinders 1 and the material to be printed is supported on the upper surface of the top horizontal reach of the belt as illustrated in FIG. 1. The lower side of the upper horizontal reach of the band 2 is supported upon supporting rollers 3 which are positioned approximately opposed to the respective printing cylinders 1 as shown in FIG. 1. The supporting rollers 3 have their opposite ends rotatably journalled upon substantially vertically extending rods 4. Vertical movement of the rod 4 in a manner to be presently described displaces the supporting roller 3 away from its respective printing cylinder.

Underneath the band 2 is a suction box 5 whose transverse edges 6 are smoothly bent into the shape as shown in FIG. 1 to facilitate the movement of the band over the end edges of the suction box. The longitudinal length of the suction box 5 is a function of the printing length S of the apparatus which is determined by the distance between the end or extreme ones of printing cylinders as shown in FIG. 1. The longitudinal length of the suction box 5 is preferably greater than the distance S as illustrated.

The rods 4 which support each end of a supporting roller 3 may be mounted either within or outside of the suction box 5. The rod 4 is slidably guided in a guide 7 so as to permit a raising and lowering of the supporting roller 3. The displacement of the supporting roller 3 is provided by a pneumatic or hydraulic adjusting cylinder 8 within which is a slideable piston 9 from which extends the rod 4. The rod 4 extends through an opening in crank end 10 of the cylinder 8. On the upper portion of the rod 4 there is provided a pin or shaft 11 that functions as an axle to support the roller 3. A connection 12 on the cylinder 8 is provided through which compressed air or hydraulic fluid can be supplied to the cylinder 8 to move the supporting roller 3 downwardly.

In order to interrupt printing, the individual supporting roller 3 need only be displaced vertically a distance of about 5 mm. This stroke is limited by the end of piston rod 13 which extends from a piston 15 slideably received in a second cylinder 14. The end of rod 13 extends into the cylinder 8 so as to be engageable by the underside of piston 9 as viewed in FIG. 2.

When the operation of the entire printing apparatus is stopped after a printing operation, each of the supporting rollers 3 together with the band 2 must be lowered a distance of about 20 mm. For this purpose, the piston 15 has a stroke of about 15 mm so that the movement of the rod 4 downwardly into contact with the piston rod 13 and the subsequent movement of the rod 4 downwardly until the piston 15 reaches the end of cylinder 14 enables a displacement to be made of about 20 mm. The cylinder 14 functions to damp the latter portion of the descending movement of the supporting roller and is also connected to a source of compressed air or hydraulic fluid in order to raise the supporting roller 3.

The suction box 5 is maintained under a vacuum which is a pressure less than the atmospheric pressure bearing upon the upper surface of endless band 2 through a conduit 16 which is connected to a vacuum pump 17 or the like to evacuate the interior of the suction box 5. The sub-atmospheric pressure will be about 20 mm water column. The lower side of the upper reach of the web 2 moves in close contact upon the upper longitudinal and transverse edges of the suction box 5 to facilitate maintaining a vacuum within the suction box.

Figure 4:
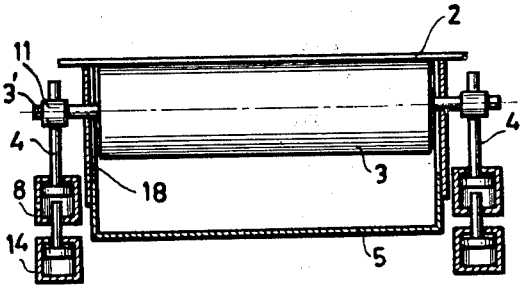
FIG. 4 is a transverse sectional view of the suction box structure of FIG. 3A.
Figure 3A:
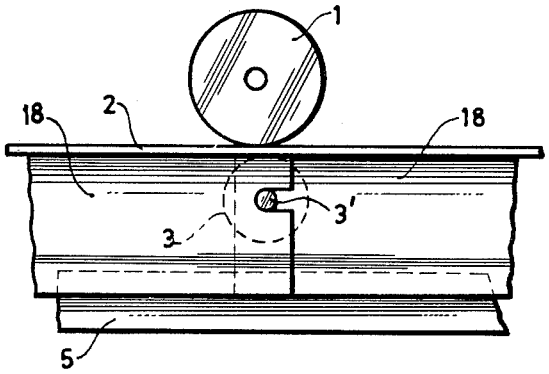
FIG. 3A is a side-elevational view of a portion of the suction box to show the structure for maintaining contact with the moving band.
Figure 3B:
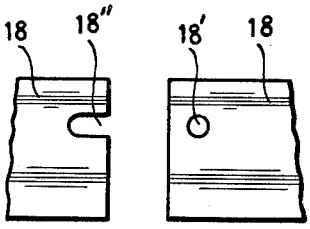
FIG. 3B is a side-elevational view of the end portions of adjacent side plates of FIG. 3A and showing the ends of the plates in separated relationship.

In the inactive or non-printing position of one printing cylinder 1, the supporting roller 3 is lowered a short distance as described above. In order to provide for complete disengagement of the band 2 with respect to the printing cylinder 1 near each supporting roller 3 a portion of the side wall of the suction box 5 consists of overlapping plates 18 capable of vertical displacement. These plates 18 are also in overlapping relationship with the fixed side wall of the suction box as may be seen in FIGS. 3A and 4. Thus, the downward movement of the plates 18 together with the downward movement of the supporting roller 3 maintains close contact between the upper edges of plates 18 and the band 2 so as to maintain the suction box 5 closed with respect to the surrounding atmosphere. The upper portion of the longitudinal sides of the suction box 5 are formed by the slightly overlapping plates 18. Each plate has a hole 18′ near one end for accommodating the axle 3′ of a roller 3. At the other end of each plate 18 there is a slit 18″ for cooperation with the axle 3′ extending through the hole 18′ in the adjacent plate 18 to provide for relative longitudinal or horizontal movement of plates 18 with respect to each other.

During operation of the printing apparatus according to the present invention when one or more printing cylinders are desired to be inactive or non-printing, compressed air is supplied through the conduit 12 to the respective cylinders 8 so that the respective supporting roller 3 is displaced downwardly. To this end the conduit 12 is connected to a port of a conventional operable valve 19 having first ports (see FIG. 2). Two ports are connected to either end of the cylinder 8. Of the three other ports, one is connected to a source of pressurized fluid and the two others to a discharge. By moving the interior element of the valve, the spaces on either side of the piston 9 are put under pressure or evacuated. In the position of the valve 19 shown in FIG. 2, the piston 9 and the roller 3 have moved downwardly.

Since there is a vacuum or sub-atmospheric pressure in the suction box 5, that portion of the band which is under the corresponding printing cylinder 1 is also moved downwardly such that the supporting roller and endless band are in the positions as shown in FIG. 2. This distance of displacement is limited to about 5 mm.

For a temporary interruption of the operation of the whole machine, all the rollers 3 are simultaneously lowered over about 20 mm by activating the cylinders 8 and 14. The piston 15 of the latter is raised and lowered by means of a conventional valve 20, see FIG. 2.

When the printing cylinders 1 consist of thin-walled cylindrical stencils each of which is provided with an internal squeegee, during the non-printing or inactive period of each cylinder stencil its squeegee 19 will also be lifted and the supply of printing paste or ink will be interrupted. During the actual printing operation the suction in the suction box 5 can be decreased, i.e. the pressure in the box 5 can be raised, so as to provide a control over the contact of the endless band with the printing cylinders.

By the utilization of a single suction box under the entire printing distance of the band 2 the printing interruption can be carried out with a smaller pressure differential than is the case when separate vacuum or suction boxes are provided for each printing cylinder. By means of the suction box 5 according to the present invention a pressure differential is maintained on both sides of the upper horizontal reach of the band 2 with the lower pressure being on the underside of the band 2 as viewed in FIG. 1.

In the embodiment of the printing apparatus disclosed herein it is pointed out that the printing distance S is horizontal but the present invention can also be applied to a printing apparatus having non-horizontal printing distances S.

Further, the present invention can also be readily applied to printing apparatus having other forms of cylindrical printing means, such as rollers and the like, in addition to cylindrical stencils as disclosed herein.

It will be understood that this invention is susceptible to modification in order to adapt it to different usages and conditions, and accordingly, it is desired to comprehend such modifications within this invention as may fall within the scope of the appended claims.

What is claimed is:

1. An apparatus for intermittent printing comprising a plurality of printing cylinders, an endless band having a reach with first and second opposed sides, said first side supporting a material to be printed and movable below said printing cylinders in contact therewith, a plurality of supporting rollers each mounted on a shaft supporting the second side of said endless band and each of said rollers opposed from a respective printing cylinder, means attached to each said supporting roller for displacing individually a said supporting roller in a transverse direction away from and toward a said respective printing cylinder, a suction chamber enclosing said plurality of supporting rollers and having an open face engageable with the second side of said endless band, said suction chamber having opposed side walls and said shafts traversing said side walls, said suction chamber maintaining a pressure on the supported second side of the band less than the atmospheric pressure acting upon the other first side of the band, each of said side walls having displaceable wall portions with said shafts extending therethrough, each of said wall portions comprising plates in overlapping relationship with a fixed side wall of the suction chamber and at the locations of the extending shafts and capable of vertical displacement to maintain close contact between the open face of the suction chamber and the second side of the endless band when the support roller is displaced away from its respective printing cylinder to interrupt the printing of that cylinder upon the material supported upon the band.

2. An apparatus as claimed in claim 1 and further comprising a pneumatic adjusting cylinder connected to each said displaceable supporting roller for the individual movement up and down of said supporting roller.

3. An apparatus as claimed in claim 2 comprising a second cylinder having a slideable piston therein and a piston rod extending from said slideable piston outwardly of said second cylinder and engageable with said adjusting cylinder to stop said adjusting cylinder and said supporting roller in a first position, said second cylinder and said adjusting cylinder further movable together away from said printing cylinder to stop said supporting roller in a second position.

* * * * *